United States Patent [19]

Henning et al.

[11] Patent Number: 4,564,426

[45] Date of Patent: Jan. 14, 1986

[54] PROCESS FOR THE DEPOSITION OF PALLADIUM-NICKEL ALLOY

[75] Inventors: Timothy P. Henning, Endwell; Robert D. Topa, Binghamton, both of N.Y.

[73] Assignee: International Business Machines Corporation, Armonk, N.Y.

[21] Appl. No.: 723,371

[22] Filed: Apr. 15, 1985

[51] Int. Cl.[4] ..... C25D 3/56

[52] U.S. Cl. ..... 204/44.6

[58] Field of Search ..... 204/44.6, 123

[56] References Cited

U.S. PATENT DOCUMENTS

| | | | |
|---|---|---|---|
| 4,100,039 | 7/1978 | Caricchio et al. | 204/44.6 |
| 4,416,740 | 11/1983 | Schulze-Berge | 204/44.6 |
| 4,416,741 | 11/1983 | Schulze-Berge | 204/44.6 |
| 4,487,665 | 12/1984 | Miscioscio et al. | 204/44.6 X |

*Primary Examiner*—G. L. Kaplan

*Attorney, Agent, or Firm*—Pollock, Vande Sande & Priddy

[57] ABSTRACT

A palladium-nickel alloy is deposited onto a substrate by electroplating from a plating bath containing palladosammine chloride, nickel ion source, ammonium sulfate, ammonium chloride, and sufficient ammonium hydroxide to provide a pH of about 7.0 to about 8.3 at a temperature of about 60° F. to about 90° F.

17 Claims, No Drawings

PROCESS FOR THE DEPOSITION OF PALLADIUM-NICKEL ALLOY

TECHNICAL FIELD

The present invention is concerned with depositing a palladium-nickel alloy onto a substrate by electrodeposition. In particular, the present invention is concerned with providing an electrodepositing process whereby the composition of the deposited alloy can be controlled in a reproducible manner. The present invention is especially concerned with providing a lustrous (uniform, satin-like bright appearance) deposit over a wide operating current density range. In addition, the present invention is concerned with the electroplating baths for this purpose.

BACKGROUND ART

Electrical components which are used to establish various circuit contacts should have a low, stable contact resistance, which can be assured only if the contact metal is a good conductor and does not substantially deteriorate with time. Noble metals, such as gold and the metals of the platinum family can be used to protect electrical contacts from corrosion and at the same time provide solderability properties and low electrical contact resistance at low loads. Such coatings have relatively low chemical reactivity and are resistant to oxidation. However, such coatings are extremely expensive.

Low-cost substitutes for such coatings have been suggested. One particularly good example is a palladium-nickel alloy. Such can be deposited in accordance with the method disclosed in U.S. Pat. No. 4,100,039 to Caricchio, Jr., et al. Although, the process disclosed in U.S. Pat. No. 4,100,039 is quite adequate, such does suffer from a few disadvantages. In particular, the amount of palladium in the deposited alloy tends to change more than desired upon use and aging of the bath. Also, in order to obtain a coating having a uniform satin bright appearance, a sulfite ion is included in the compositions disclosed in U.S. Pat. No. 4,100,039. Moreover, obtaining higher nickel concentrations in coatings made pursuant to the method disclosed in U.S. Pat. No. 4,100,039 is quite difficult.

SUMMARY OF INVENTION

In accordance with the present invention, palladium-nickel alloys can be reproducibly deposited at relatively high rates. In addition, according to the present invention, the composition of the deposited alloy can be more easily controlled and is less susceptive to changes due to aging of the bath as compared to the baths disclosed in U.S. Pat. No. 4,100,039.

In addition, the present invention makes it possible to more readily change the composition of the deposited alloy by changing certain parameters of the bath and/or operating conditions. The present invention makes it possible to more readily obtain coatings having higher nickel concentrations as compared to the process disclosed in U.S. Pat. No. 4,100,039. In addition, the bath of the present invention does not require as careful control of certain parameters as do prior art palladium-nickel electroplating baths.

In particular, the present invention is concerned with an aqueous electroplating bath for depositing palladium-nickel alloy which comprises:

(a) about 9 to about 15 grams per liter of palladium ion derived from palladosammine chlorides;

(b) about 10 to about 24 grams per liter of nickel ion;

(c) about 10 to about 50 grams per liter of ammonium sulfate;

(d) about 10 to about 50 grams per liter of ammonium chloride;

(e) and sufficient amount of ammonium hydroxide to provide a pH of about 7.0 to about 8.3 and to solubilize the palladium and nickel metal ions into soluble ammonia complexes.

In addition, the present invention is concerned with a method for depositing a palladium-nickel alloy onto a substrate. The method comprises subjecting an anode to the aqueous electroplating bath described hereinabove and immersing the substrate to be coated in the bath and in spaced relationship to the anode. A plating current is applied to the bath and the temperature of the bath is maintained during the plating at about 60° F. to about 90° F.

BEST AND VARIOUS MODES FOR CARRYING OUT INVENTION

In accordance with the present invention, the aqueous electroplating bath contains about 9 to about 15 grams per liter and preferably about 10 to about 12.5 grams per liter of palladium ion derived from palladosammine chloride. The plating bath also contains about 10 to about 24 grams per liter and preferably about 12 to about 20 grams per liter of nickel ion. The source for the nickel ion can be a nickel salt such as nickel sulfamate, nickel chloride, or nickel sulfate. If desired, mixtures of these salts can be used.

The plating bath in accordance with the present invention also contains about 10 to about 50 grams per liter and preferably about 25 to about 50 grams per liter of ammonium sulfate and about 10 to about 50 grams per liter and preferably about 20 to about 50 grams per liter of ammonium chloride. It is important to the practice of the present invention that both the ammonium sulfate and ammonium chloride salts be employed. By employing the particular combination of ammonium salts, the coated deposit obtained is lustrous, forming a uniform satin-like bright appearance. This is accomplished without the necessity of adding a brightener such as the sulfite disclosed for such purposes in U.S. Pat. No. 4,100,039 or various organic brighteners suggested in U.S. Pat. No. 4,463,060 to Uptegraff. Being able to exclude the presence of such brighteners and still obtain a bright lustrous coating is a significant advantage particularly since the brighteners suggested in the prior art in the amounts used are difficult to monitor and to regulate or control. For instance, small changes in the brightener level in prior art baths can result in significant changes in the deposit.

The electroplating baths of the present invention also contain sufficient amount of ammonium hydroxide so as to provide a pH of about 7.0 to about 8.3 and preferably about 7.7 to about 8.1. The ammonium hydroxide solubilizes the palladium and nickel metal ions into soluble ammonia complexes in the plating bath. The ammonium hydroxide is preferably added as a concentrated aqueous solution containing about 25% to about 30% by weight of ammonia.

In view of the parameters selected in accordance with the present invention, the deposited layer contains increased amounts of nickel which is desirable since the nickel is the least expensive of the metals in the alloy. It is believed, that the baths of the present invention contain a lesser amount of ammonia gas and accordingly a lower ratio of ammonia gas to ammonium ion as compared to the prior nickel-palladium plating baths. This ratio of ammonia to ammonium ions in the plating bath is believed to control what type of complex is formed with the nickel. For instance, with higher amounts of ammonia gas, the complex formed is the nickel hexamine as compared to nickel tetraamine with lesser amounts of ammonia ions. Since the complex with the lesser amount of ammonia (four amino groups as opposed to six amino groups) tends to deposit more easily, this ratio becomes significant. It is believed, that the ratio of ammonia gas to ammonium ions in the baths of the present invention is less than about 0.1 and preferably less than about 0.05. Not only does the nickel more easily deposit than compared to prior art plating baths but the bath is more stable in that the buffering in the prior baths is caused by the ammonia gas which tends to be depleted from the system thereby rendering the bath relatively unstable as compared to the baths of the present invention. The baths of the present invention are buffered by sulfate ion system which is not depleted by volatilization.

It has further been noted that use of the pH range according to the present invention as compared to the preferred pH range disclosed in U.S. Pat. No. 4,100,039 results in a lesser change in the deposited composition as compared to the change observed in following the suggestions of U.S. Pat. No. 4,100,039. In particular, the deposited layer composition only changed about 2% by varying the pH over the preferred range required in accordance with the present invention. On the other hand, varying the pH over the range of about 8.8 to about 9.5 in accordance with U.S. Pat. No. 4,100,039 results in a change of the deposited alloy of about 8%. Accordingly, the present invention can be operated over the preferred pH range employed in the present invention without significantly affecting the deposited layer. Accordingly, the pH need only be maintained within the range required by the present invention without critical control within the range itself. Furthermore, changes in the amount of ammonium ion (ammonium chloride and/or ammonium sulfamate) in baths in accordance with U.S. Pat. No. 4,100,039 results in much greater changes in the deposited alloy as compared to changes in the ammonium chloride and/or ammonium sulfate in the baths of the present invention. This is particularly important since as the plating process proceeds in manufacture, additions of palladium and/or nickel to replenish the bath will cause changes in the concentrations of the chloride, sulfate or sulfamate. Therefore, reduced changes in the deposited layer as achieved by the present invention in view of changes in these materials is quite desirable.

Examples of parts which can be plated in accordance with the present invention and apparatus for plating are adequately disclosed in U.S. Pat. No. 4,100,039, the disclosure of which is incorporated herein by reference.

The plating method of the present invention includes subjecting an anode to the aqueous electroplating bath of the present invention and also immersing a substrate to be coated in the bath. The substrate is in a spaced relationship to the anode. The substrate is an electrically conductive substrate and can prior to the palladium-nickel alloy plating be plated with a metal such as nickel in a conventional nickel plating process. Examples of some suitable substrates are nickel, copper, and copper beryllium alloy. The plating in accordance with the present invention is carried out at temperatures of about 60° F. to about 90° F. and preferably 75° F. to about 82° F. It is important that the temperature not exceed 90° F. during the plating.

In addition, the plating can be carried out over a wide range of current density such as at about 1 to about 60 amperes per square foot and preferably at about 20 to about 60 amperes per square foot. The plating is usually carried out to provide thicknesses of the plated film of about 30 to about 250 microinches. The plating for instance at a current density of about 10 amperes per square feet proceeds at about 13 microinches per minute.

In addition, during the plating it is desirable that the electroplating bath and the substrate to be plated are agitated. For instance, the substrates can be agitated by connecting such to a rack and having the rack move back and forth horizontally by suitable motor means to thereby agitate the rack. The electroplating solution can be agitated by suitable pumping means. The plating tank also includes an anode to complete the circuitry. After the plating, the plated substrates can be rinsed in hot deionized water and dried such as in a forced air oven for about 5 to 10 minutes.

The plated deposits in accordance with the present invention exhibit good corrosion resistance, hardness and ductility and provide low electrical resistance through contacts. In addition, it is noted that the process of the present invention allows for significant "overvoltage" without the generation of significant quantities of hydrogen which would interfere with the deposition of the coating and/or its quality. The process of the present invention as discussed above can be carried out employing relatively high current densities which provide higher plating rates and thereby increasing the production of the product.

It is further noted that the baths of the present invention can tolerate increased levels of impurities which may be introduced from the environment such as dust and airborne particles without interfering with the plating process.

Deposited alloys prepared in accordance with the present invention can be controlled to include weight ratio palladium to nickel of about 50:50 to about 95:5 and preferably about 70:30 to about 80:20.

The following non-limiting examples are presented to further illustrate the present invention:

EXAMPLE I

An electroplating bath is prepared by adding about 10 grams per liter of palladium ion derived from palladosammine chloride along with about 14 grams per liter of a nickel ion derived from nickel chloride, about 30 grams per liter of ammonium chloride, and about 40 grams per liter of ammonium sulfate and concentrated ammonium hydroxide (about 28% $NH_3$ weight percent) to provide a pH of about 7.94. The bath is held at a temperature of about 75° F. to about 82° F. while the plating is carried out under a current density of about 10 amperes per square foot for about 10 minutes. During the plating, the rack is agitated through suitable reciprocation of the cathode rack head and in addition, the plating solution is agitated through a pumping station. A uniform palladium-nickel alloy coating of about 130 microinches thickness results with a ratio of about 61% palladium to about 39% nickel in the plated alloy as measured by energy dispersive X-ray spectroscopy in a scanning electron microscope. The coating is a lustrous satin-like uniform coating.

EXAMPLE II

Example I is repeated except that the ammonium hydroxide is added in an amount to provide a pH of about 7.0. The composition of the alloy contains about 74% by weight palladium and about 26% by weight of nickel.

EXAMPLE III

Example I is repeated except that the ammonium hydroxide is added in an amount to provide a pH of about 7.3 resulting in an alloy containing about 72% by weight of palladium and about 28% by weight of nickel.

EXAMPLE IV

Example I is repeated except that the ammonium hydroxide is added in an amount to provide a pH of about 7.7. The resulting alloy contains about 62% by weight palladium and about 38% by weight of nickel.

EXAMPLE V

Example I is repeated except that the ammonium hydroxide is added in an amount to provide a pH of about 8.1. The resulting deposit contains about 60% by weight palladium and about 40% by weight of nickel.

COMPARISON EXAMPLE VI

Example I is repeated except that the ammonium hydroxide is added to provide a pH of about 8.4. The resulting deposit contains about 70% by weight of palladium and about 30% by weight of nickel.

COMPARISON EXAMPLE VII

Example I is repeated except that the ammonium hydroxide is added to provide a pH of about 8.65. The resulting deposit contains about 78% by weight of palladium and about 22% by weight of nickel.

COMPARISON EXAMPLE VIII

Example I is repeated except that the ammonium hydroxide is added to provide a pH of about 9.0. The resulting deposit contains about 88% by weight of palladium and about 12% by weight of nickel.

COMPARISON EXAMPLE IX

Example I is repeated except that the ammonium hydroxide is added to provide a pH of about 9.4. The resulting deposit contains about 90% by weight of palladium and about 10% by weight of nickel.

Having thus described our invention, what we claim as new and desire to secure by Letters Patent is:

1. An electroplating aqueous bath for depositing palladium-nickel alloy which comprises:

(a) about 9 to about 15 grams per liter of palladium ion derived from palladosammine chloride;
(b) about 10 to about 24 grams per liter of nickel ion;
(c) about 10 to about 50 grams per liter of ammonium sulfate;
(d) about 10 to about 50 grams per liter of ammonium chloride;
(e) and sufficient ammonium hydroxide to provide a pH of about 7.0 to about 8.3 and to solubilize the palladium and nickel metal ions into soluble ammonia complexes.

2. The electroplating aqueous bath of claim 1 wherein said pH is about 7.7 to about 8.1.

3. The aqueous electroplating bath of claim 1 wherein about 10 grams per liter of palladium ion are employed.

4. The aqueous electroplating bath of claim 1 which comprises about 14 grams per liter of nickel ion.

5. The aqueous electroplating bath of claim 1 wherein the source of nickel ion is nickel chloride.

6. The aqueous electroplating bath of claim 1 which comprises about 40 grams per liter of ammonium sulfate.

7. The aqueous electroplating bath of claim 1 which comprises about 30 grams per liter of ammonium chloride.

8. The aqueous electroplating bath of claim 1 which comprises about 10 grams per liter of palladium ion; about 14 grams per liter of nickel ion; about 40 grams per liter of ammonium sulfate; about 30 grams per liter of ammonium chloride; and sufficient ammonium hydroxide to provide a pH of about 7.7 to about 8.1.

9. The aqueous electroplating bath of claim 1 wherein said nickel ion is derived from a nickel salt selected from the group of nickel sulfamate, nickel chloride, nickel sulfate, and mixtures thereof.

10. A method for depositing a palladium-nickel alloy on a substrate which comprises:

(a) subjecting an anode to an aqueous bath comprising:
  (1) about 9 to about 15 grams per liter of palladium ion derived from palladosammine chloride;
  (2) about 10 to about 24 grams per liter of nickel ion
  (3) about 10 to about 50 grams per liter of ammonium sulfate;
  (4) about 10 to about 50 grams per liter of ammonium chloride;
  (5) and sufficient ammonium hydroxide to provide a pH of about 7.0 to about 8.3 and to solubilize the palladium and nickel metal ions into soluble ammonia complexes;
(b) immersing the substrate to be coated in said bath and in spaced relationship to said anode;
(c) applying a plating current to said bath; and,
(d) maintaining said bath at temperature of about 60° F. to about 90° F. during the plating.

11. The method of claim 10 wherein said plating current is about 1 to about 60 amperes per square foot.

12. The method of claim 10 wherein said plating current is about 20 to about 60 amperes per square foot.

13. The method of claim 10 wherein said nickel ion is derived from a nickel salt selected from the group of nickel sulfamate, nickel chloride, nickel sulfate, and mixtures thereof.

14. The method of claim 10 wherein the temperature during the plating is about 75° F. to about 82° F.

15. The method of claim 10 wherein said substrate is an electrically conductive substrate.

16. The method of claim 10 which comprises agitating both the plating bath and substrate during the plating.

17. The method of claim 10 wherein said substrate is formed of metal selected from the group of nickel, copper, and a copper-beryllium alloy.

* * * * *